US009677237B2

(12) United States Patent
Phelps

(10) Patent No.: US 9,677,237 B2
(45) Date of Patent: Jun. 13, 2017

(54) SELF-FILLING MODULAR BARRIER

(71) Applicant: FLUVIAL INNOVATIONS LTD, Poole, Dorset (GB)

(72) Inventor: Simon Thomas Phelps, Poole (GB)

(73) Assignee: FLUVIAL INNOVATIONS LTD, Poole (GB)

( * ) Notice: Subject to any disclaimer, the term of this patent is extended or adjusted under 35 U.S.C. 154(b) by 0 days.

(21) Appl. No.: 14/775,057

(22) PCT Filed: Mar. 13, 2014

(86) PCT No.: PCT/GB2014/000095
§ 371 (c)(1),
(2) Date: Sep. 11, 2015

(87) PCT Pub. No.: WO2014/140515
PCT Pub. Date: Sep. 18, 2014

(65) Prior Publication Data

US 2016/0032546 A1 Feb. 4, 2016

(30) Foreign Application Priority Data

Mar. 15, 2013 (GB) ..... 1304755.0

(51) Int. Cl.
*E02B 3/10* (2006.01)
*E02D 17/20* (2006.01)

(52) U.S. Cl.
CPC ..... *E02B 3/108* (2013.01); *E02B 3/106* (2013.01); *E02D 17/205* (2013.01)

(58) Field of Classification Search
CPC combination set(s) only.
See application file for complete search history.

(56) References Cited

U.S. PATENT DOCUMENTS 4,650,368 A 3/1987 Bayer ..... 405/111
4,946,306 A * 8/1990 Yodock ..... E01F 9/669 256/13.1

(Continued)

FOREIGN PATENT DOCUMENTS

DE 201 09 417 U1 1/2001 ..... E04B 1/92
WO WO 2007/000612 A1 1/2007 ..... E02B 3/10
WO WO 2009/005342 A1 1/2009 ..... E02B 3/10

OTHER PUBLICATIONS

International Search Report mailed Jun. 6, 2014 in corresponding application No. PCT/GB2014/000095.

(Continued)

*Primary Examiner* — Kyle Armstrong
(74) *Attorney, Agent, or Firm* — Renner Kenner Greive Bobak Taylor & Weber

(57) ABSTRACT

A flood barrier unit having a base and at least one side wall is provided. The walls of the unit are tapered such that it is capable of being stacked vertically with other such units when not in use. The unit preferably includes at least one connection slot on each wall, wherein each connection slot is adapted to sealingly accept a connection piece. A plurality of such units may be connected together to form a watertight flood barrier, where adjacent units are adapted to be connected together in a watertight manner using one connection piece. Additional connection pieces suitable for sealingly engaging a vertical structure such as the wall of a building are also provided.

31 Claims, 11 Drawing Sheets

(56) References Cited

U.S. PATENT DOCUMENTS

| | | | | |
|---|---|---|---|---|
| 7,530,763 | B2 | 5/2009 | Heselden | 405/15 |
| 7,712,998 | B2 | 5/2010 | Salemie | 405/111 |
| D631,977 | S | 2/2011 | Taylor | D25/38 |
| 2006/0113303 | A1* | 6/2006 | Huruta | B65D 21/0204 220/23.4 |
| 2006/0201943 | A1 | 9/2006 | Uffner et al. | 220/23.83 |
| 2007/0009326 | A1 | 1/2007 | Jananbakhsh | 405/114 |
| 2007/0108085 | A1 | 5/2007 | Andrade | 206/515 |
| 2007/0116522 | A1 | 5/2007 | Boudreaux, Jr. | 405/114 |
| 2010/0150667 | A1 | 6/2010 | Phelps | 405/284 |
| 2010/0186216 | A1 | 7/2010 | Reedijk et al. | 29/592 |

OTHER PUBLICATIONS

Written Opinion mailed Jun. 6, 2014 in corresponding application No. PCT/GB2014/000095.

UK Search Report mailed Aug. 9, 2013 in corresponding application No. GB1304755.0.

* cited by examiner

SELF-FILLING MODULAR BARRIER

CROSS-REFERENCE TO RELATED APPLICATION

This is a §371 application of International patent application number PCT/GB2014/000095 filed Mar. 13, 2014, which claims the benefit of Great Britain patent application number 1304755.0 filed on Mar. 13, 2013, both of which are incorporated herein by reference.

TECHNICAL FIELD

The present invention provides a modular system and units thereof that are suitable for providing a barrier for the containment of fluids. The units are shaped such that they stack within one another when not in use, facilitating easy storage and transportation. The system is advantageously deployed in a variety of situations, such as protecting buildings from flood damage.

BACKGROUND ART

Globally flooding is becoming more and more frequent due to climate change and the increase in development on floodplains. The Associated of British Insurers (ABI) released figures indicating that 486,000 claims for flood and storm damage were received in 2012, resulting in £1.19 billion in insurance payouts, leading the ABI to declare flooding to be the greatest natural threat currently facing the UK.

Flooding is generally unpredictable in that it is often not possible to know in advance exactly when flooding will occur, for how long it will last and what the total volume of floodwater will be. In some circumstances significant volumes of floodwater can accumulate in under a few hours with very little advance warning.

It is desirable to put flood defences in place as soon as possible after the risk of flooding has been identified, since typically early deployment of such defences will reduce or even entirely eliminate the damage caused by flooding.

Prior art flood barriers that are easy to rapidly deploy exist. One example is disclosed in WO 2007/000612 A1, which discloses a flood barrier formed from self-filling units that are interconnected by slide-in keys that are inserted into sockets at the end of the units. The keys incorporate ballast for negative buoyancy and are located between adjacent units in the barrier.

Whilst exhibiting several advantageous features, a disadvantage of this flood barrier is that it is of a fixed height. This means that it is not possible to guarantee that the height of the barrier will be sufficient to hold back an unexpectedly large volume of floodwater.

Another disadvantage of this flood barrier is that the units it is formed from do not make particularly efficient use of the space available during transit or storage.

A further disadvantage of this flood barrier is that it is relatively inflexible with regard to interconnection options between adjacent units forming the barrier. In particular, adjacent units can only be connected to one another in an end-to-end configuration. This means that the depth of this barrier is fixed at the width of a single unit; i.e. the barrier is only a single unit deep. Additionally, one or more curved units are needed if a barrier having a curved profile is required.

SUMMARY OF THE INVENTION

In a first aspect, the present invention provides a unit for forming part of a flood barrier. The unit includes a number of connection slots that accept connection pieces, such that the unit can be sealingly connected to another similar unit. This unit offers more interconnection options than are available in prior art flood barrier units. In preferred embodiments the connection slots and connection keys are tapered, so that a component of the weight of the unit acts to compress the unit onto the connection key and thereby improve the seal between them. In some particularly preferred embodiments the unit includes at least one self-filling hole to allow flood water to enter it while it is deployed.

Accordingly, the present invention provides a unit suitable for deployment as part of a flood barrier, comprising: a hollow body comprising a base and at least one wall, wherein the angle between the at least one wall and the base is greater than 90 degrees; wherein the at least one wall includes at least one recess therein, each recess forming a connection slot that is suitable for accepting a connection piece.

The present invention also provides a flood barrier, comprising: a plurality of such units and a plurality of connection pieces; wherein the plurality of units are connected together using said plurality of connection pieces such that the combination forms a watertight barrier.

In a second aspect, the present invention provides a stackable unit for forming part of a flood barrier. The unit can be stacked vertically with a number of other such units, greatly reducing the space required to store or transport the units. The vertical stack of units also advantageously includes space to accommodate connection pieces that are used to connect adjacent units together when they are deployed. This means that all the parts required to assemble a flood barrier that is several tens of meters in length can be easily stored in a relatively small space. This is particularly advantageous during transit of such parts.

BRIEF DESCRIPTION OF THE DRAWINGS

Embodiments of the invention will now be provided by way of example only with reference to the drawings in which.

BEST MODE FOR CARRYING OUT THE INVENTION

Figure 1A:
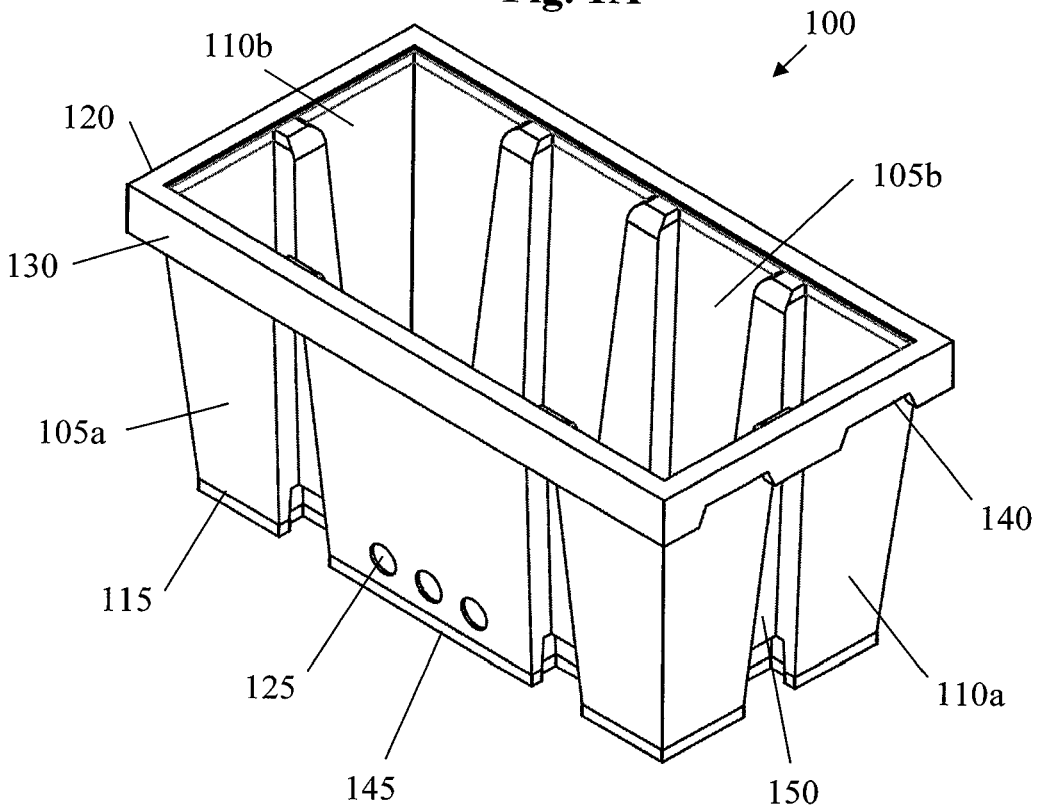
FIG. 1A is a top-down perspective view of a modular unit according to an embodiment of the present invention that is suited for deployment as part of a flood barrier.

The following disclosure may at times refer to 'flood water', 'water', 'flood barrier', 'barrier', 'watertight' and the like, but it will be understood that embodiments of the present invention have application beyond forming a barrier to flood water. Specifically, embodiments of the present invention may be used to form a barrier against any fluid in general, including but not limited to salt water, fresh water, sewage, toxic spills and the like. Embodiments may be used to form a barrier against such fluids, preventing them from passing and causing damage to buildings and the like located behind the barrier. Embodiments may also be assembled to contain a fluid within a fixed volume and so serve as a fluid containment means, such as for example for containing a cleansing pool for disease prevention, or as temporary containment for fish and other such aquatic life.

A modular unit generally denoted by the reference numeral 100 according to an embodiment of the present invention is shown in FIGS. 1A-1E. Unit 100 is suitable for deployment as part of a barrier for the containment of fluids, or for deployment as part of a flood defence system or flood barrier.

As best shown in FIG. 1A, in the present embodiment unit 100 is a hollow parallelepiped that comprises a front wall 105*a*, a back wall 105*b*, two end walls 110*a*, 110*b* and a substantially flat base 115. Opposite base 115 is an open top portion 120 that can be used to access the interior of unit 100. While this shape is preferred, other hollow shapes may be used instead.

In the present embodiment unit 100 is 1 meter in length, 0.56 meters in width and 0.52 meters in height, and walls 105*a*, 105*b*, 110*a* and 110*b* are uniformly 6 mm in thickness. Base 115 is 6 mm thick. These shape and dimensions are however not essential to the present invention, and other shapes and dimensions may be used so long as they allow adjacent units to have the strength required to contain or otherwise withstand fluid pressure exerted on them, to stack within one another and to sealingly interconnect in the manner described later in this specification.

Unit 100 is formed of a lightweight material that has sufficient strength and rigidity to withstand the pressure exerted upon it by a fluid when it is deployed. The selected material should also not react with or otherwise be corroded by the fluid or fluids it is reasonably expected to be exposed to during use.

In the present embodiment unit 100 is formed from medium density polyethylene, preferably of a density such that a single 1 m by 0.56 m by 0.5 m unit having walls of thickness 6 mm and a base of thickness 6 mm weights approximately 10 kilograms. This advantageously allows each unit 100 to be easily and safely lifted by a single person, allowing one person to easily and quickly assemble a flood barrier formed from a series of units like unit 100. Unit 100 may be formed, at least in part, of any other materials known to the skilled person that meet these criteria.

Figure 1B:
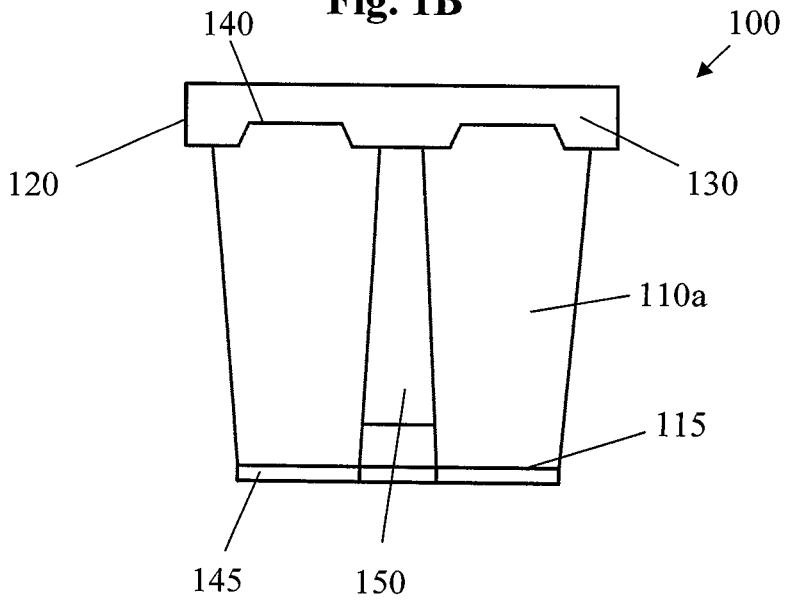
FIG. 1B is an end view of the modular unit of FIG. 1A.
Figure 1C:
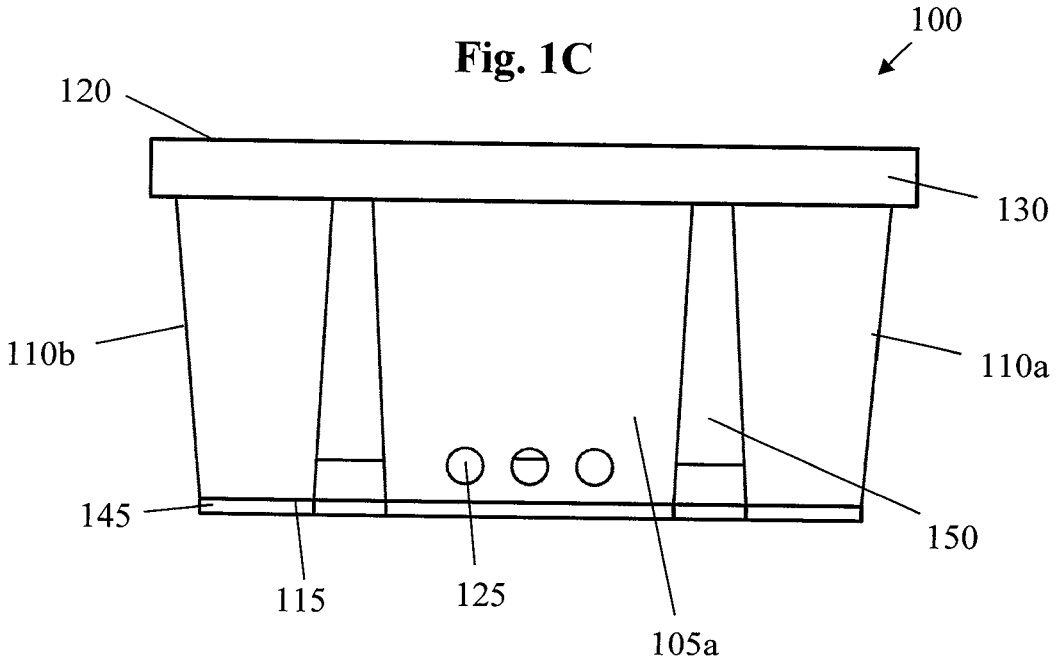
FIG. 1C is a front view of the modular unit of FIG. 1A.

As best shown in FIGS. 1B and 1C, front wall 105*a*, back wall 105*b* and end walls 110*a*, 110*b* of unit 100 are tapered, such that the area of base 115 is less than the area of top 120. The exact angle of taper is not critical to the present invention, but is preferably such that the angle between base 115 and each of walls 105*a*, 105*b*, 110*a* and 110*b* is greater than 90 degrees, and more preferably in the range 91 to 100 degrees.

In the embodiment shown in FIGS. 1A-1E, the angle of taper is about 95 degrees and is substantially identical for walls 105*a*, 105*b*, 110*a* and 110*b*. Again, this is not critical, and alternative embodiments having front and back walls with a different angle of taper to that of the end walls are also contemplated. The tapered walls advantageously allow unit 100 to stack vertically within other identical units, as is described later in this specification in conjunction with FIGS. 4A and 4B.

Unit 100 can be deployed as a self-filling unit. In this instance unit 100 includes at least one self-filling hole in at least one of walls 105*a*, 105*b*, 110*a* and 110*b*. In the embodiment shown in FIGS. 1A-1E three self-filling holes 125 are provided in front wall 105*a*, and no other self-filling holes are provided in unit 100. The self-filling holes allow flood water to enter the inner volume of unit 100 while it is deployed as part of a flood defence system or flood barrier, with the flood water serving as ballast for the deployed unit. The self-filling holes are thus preferably located towards the bottom of unit 100 (i.e. closer to base 115 than top portion 120), since such location will allow water to enter unit 100 even when the level of flood water is low.

In the present embodiment self-filling holes 125 are located symmetrically with respect to the vertical bisector of front wall 105*a*, but this is not critical and other locations for self-filling holes on this and/or on other walls are contemplated. Self-filling holes 125 are circular in this embodiment, but again this is not critical and other shapes such as square or rectangular can be used instead.

Preferably unit 100 is oriented such that, when deployed as part of a flood defence system or flood barrier, only the wall or walls in direct contact with flood water contain at least one open self-filling hole. In the embodiment of FIGS. 1A-1E, this means that unit 100 is preferably located such that front wall 105*a* abuts a flood plain. Any self-filling holes that are not required in a particular instance may be plugged using a suitable means such as a screw-in cap or bung, either before or after deployment of unit 100. Additionally, one or more self-filling holes may be plugged or unplugged while unit 100 is deployed, in order to adjust the rate at which water enters unit 100.

Unit 100 can also be deployed as a pre-filled unit. In this case all of the self-filling holes are plugged, such that unit 100 can be filled with and contain a suitable ballast material. In an alternative embodiment, a unit is provided without any self-filling holes, so plugging is not necessary. In either case, the unit can be filled with ballast material via open top portion 120.

Suitable ballast materials include a fluid such as water, or a particulate material like sand. Preferably unit 100 is filled with a ballast material once it has been placed in position, since the addition of ballast material will greatly increase the total weight of unit 100 and hence reduce unit portability. Where a fluid ballast material is used, the plugging means may be removed from any self-filling holes provided in unit 100 to allow the ballast fluid to drain out of the unit once it is no longer needed. In this manner a pre-filled unit may be easily and quickly turned into a self-filling unit that is far easier to transport.

Whether deployed as a self-filling or pre-filled unit, unlike some prior art barrier units, unit 100 does not require any in-situ preparation, such as bolting to the ground, when it is deployed. This advantageously reduces the time taken to deploy unit 100.

Unit 100 also includes a thickened portion that extends outwardly in the plane of top potion 120. The thickened portion is provided around the entire perimeter of top potion 120 to form a lip 130 that, as described in detail later in this specification, co-operates with grooves in the outer surface of unit 100 to lock an interconnection piece in place. In the present embodiment lip 130 extends 3 cm beyond walls 105*a*, 105*b*, 110*a*, 110*b*, but other thicknesses may be used. As best shown in FIGS. 1B, 1C and 1E, lip 130 also extends downwards from top portion 120 and towards base 115, and as shown in FIG. 1E an air gap 135 between lip 130 and each of walls 105*a*, 105*b*, 110*a*, 110*b* is provided around the entire perimeter of lip 130. This air gap assists in the handling of unit 100 by increasing the purchase that can be gained on the unit during lifting, and therefore is preferably large enough to accommodate human fingers and/or mechanical lifting means.

As best shown in FIG. 1B, lip 130 also includes four hand holds 140, arranged in pairs at each of end walls 110*a*, 100*b*. Hand holds 140 co-operate with air gap 135 to assist a person or mechanical lifting means in gripping unit 100 when manoeuvring it into position. Hand holds 140 are formed by providing a recess in the underside of lip 130. Preferably hand holds 140 are positioned relative to front and back walls 105*a*, 105*b* such that a pair of hand holds is within easy reach regardless of whether unit 100 is approached from the front or back. Fewer or more hand holds than four may be provided, or they may be omitted entirely. At least one hand hold may also be provided in the portion of lip 130 that is adjacent at least one of front wall 105*a* and back wall 105*b*.

In the present embodiment unit 100 further includes a sealing layer 145 that covers substantially all of the area of base 115. In the present embodiment sealing layer 145 is 2 cm thick, but other thicknesses may be used. Sealing layer 145 forms a substantially watertight seal between base 115 and the surface that unit 100 is deployed on, preventing fluid from passing under unit 100. In the present embodiment sealing layer 145 is a foam gasket, but other suitable materials known to the skilled person may be used instead of or in addition to a foam gasket. A foam gasket sealing layer is preferred because it is soft but hard-wearing. Additionally, the foam gasket conforms to the contours of the surface on which unit 100 is deployed. This helps unit 100 to form a watertight seal against this surface, even when the surface is somewhat uneven.

As best shown in FIGS. 1A and 1E, a number of connection slots 150 are provided in the exterior surface of unit 100. Connection slots 150 are used to connect unit 100 to at least one other, similar unit via a connection piece that is described later in this specification in conjunction with FIGS. 2A-2C.

In the present embodiment seven substantially identical connection slots 150 are provided: one in each of end walls 110*a*, 110*b*, two in front wall 105*a* and three in back wall 105*b*. The present invention is however not limited to this arrangement and any other arrangement and number of connection slots may be provided instead. Embodiments having at least three connection slots, one in each of end walls 110*a*, 110*b*, and one in one of front wall 105*a* or back wall 105*b*, are preferred. Embodiments having at least one connection slot in each of walls 105*a*, 105*b*, 110*a* 110*b* are more preferred. For embodiments having self-filling holes, it is preferred that the holes and connection slots are located such that they do not overlap with one another.

Each connection slot 150 comprises a moulded recess in one or more of wall 105*a*, 105*b*, 110*a*, 110*b* of unit 100 that extends across substantially all of the vertical extent of unit 100. As shown in FIG. 1E, a portion of base 115 is absent where each connection slot 150 meets it such that, when in place, a connection piece of the type shown in FIGS. 2A-2C sits in direct contact with the surface on which unit 100 is deployed. This arrangement allows a connection piece to sealingly engage with the full vertical extent of a wall of unit 100, so that no gaps that allow fluid passage are present between the connection piece and the wall of the unit or between the base of the connection piece and the surface on which unit 100 is deployed.

In the present embodiment connection slot 150 is tapered in the plane of the wall in which it is formed, such that it is wider at base 115 of unit 100 than it is at the top of unit 100. This shape allows a connection piece to have a wide, stable base. As shown most clearly in FIGS. 1B and 1E, the maximum width of a connection slot 150 is less than the full horizontal extent of the face of unit 100 in which the slot is formed. Preferably each connection slot is narrower at its widest point than the face of unit 100 in which it is formed. In the present embodiment each connection slot 150 is 12.5 cm at its widest point (the base), but other widths can be used. Connection slot 150 should not however be so narrow as to reduce the ability of a connection piece that is secured in connection slot 150 to hold back flood water.

Having a connection slot that is narrower than the face of unit 100 that it is formed in advantageously means that multiple connection slots can be formed in a single face of unit 100, increasing the number and flexibility of deployment options of a fluid barrier formed from units like unit 100. Deployment options are discussed later in this specification. Further, making connection slot 150 narrower than a width of a face of unit 100 avoids potentially weakening unit 100 by having to cut a large portion of material out of a face of the unit to form a connection slot. Additionally, a relatively narrow connection slot 150 allows a correspondingly relatively narrow connection piece, reducing the weight of such pieces and hence improving the portability of the units. The space required to store a set of units and connection pieces is also reduced, as discussed later in connection with FIGS. 4A and 4B.

Connection slot 150 is also tapered in the plane perpendicular to the wall in which it is formed, so that it is set deeper into the wall in which it is formed at the base of said wall than at the top. This is most clearly shown in FIG. 3. This second taper has the effect of directing a component of the weight of unit 100 onto a connection piece, compressing unit 100 against the connection piece and hence improving the seal between them. This is particularly so when combined with self-filling holes 125, since the influx of water via these self-filling holes increases the total weight of unit 100 and hence continuously improves the seal between unit 100 and the connection piece as the unit fills.

Figure 2A:
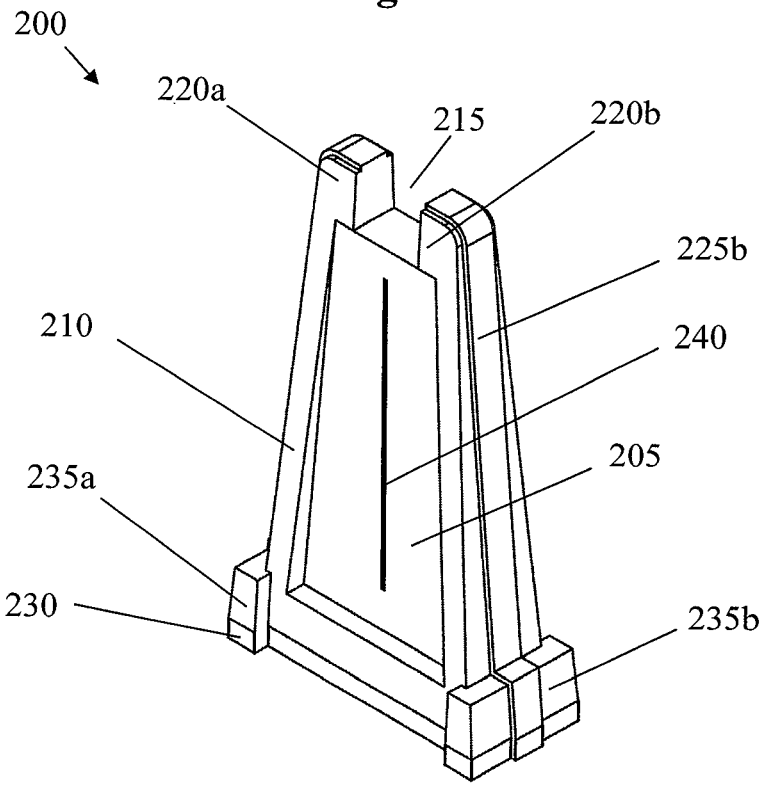
FIG. 2A is a perspective view of a connection piece according to an embodiment of the present invention that is suitable for connecting together modular units like the unit shown in FIGS. 1A-1E to form a flood barrier.
Figure 2B:
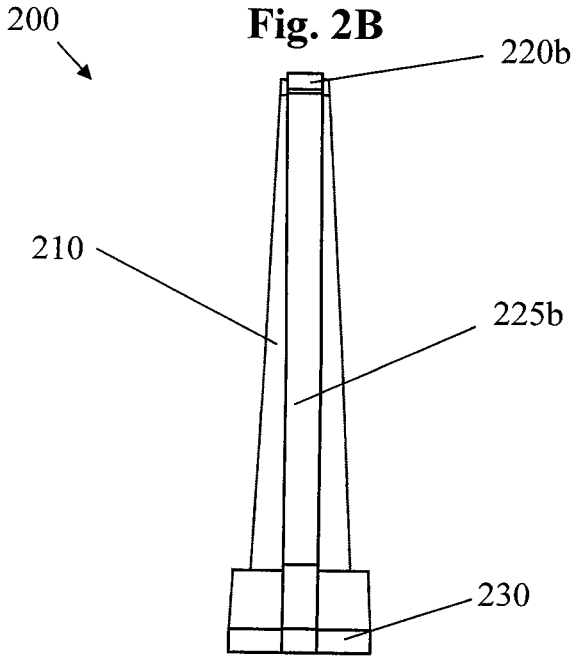
FIG. 2B is a side view of the connection piece of FIG. 2A.
Figure 2C:
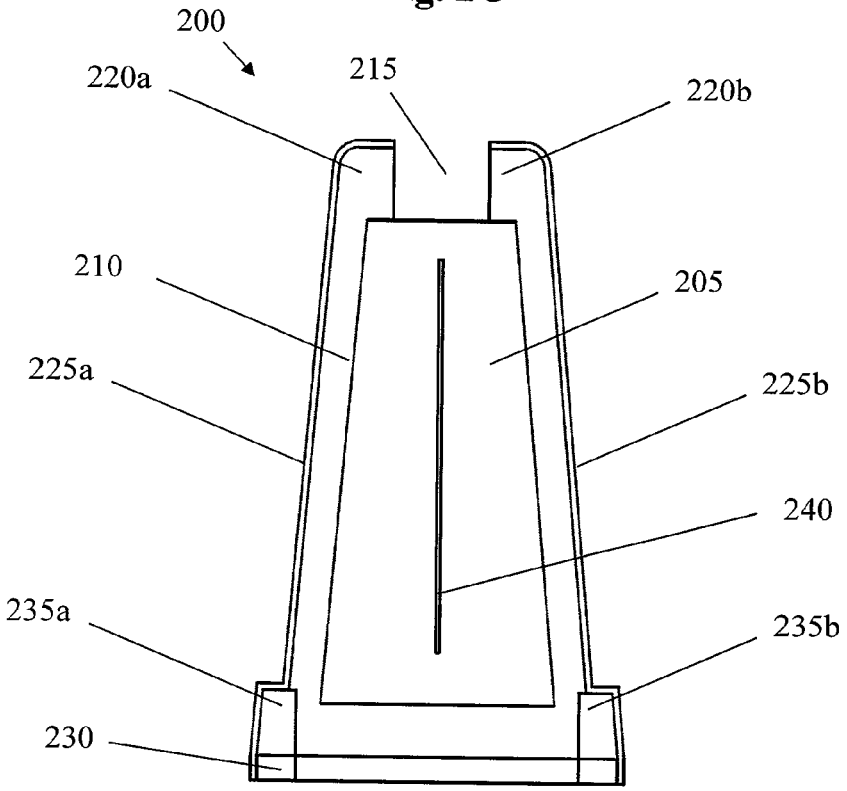
FIG. 2C is a front view of the connection piece of FIG. 2A.

The angle of both tapers is not critical, but should be chosen to complement the shape and dimensions of a connection piece of the type shown in FIGS. 2A-2C. In particular, the dimensions of each connection slot 150 are preferably chosen such that the connection piece will fit fully into connection slot 150 and remain there in an interference fit arrangement in sealing contact with a wall of unit 100. In the present embodiment, the angle of the second taper is chosen to be the same as the angle of taper of each wall of unit 100, but this is not essential and other angles may be chosen.

Figure 3:
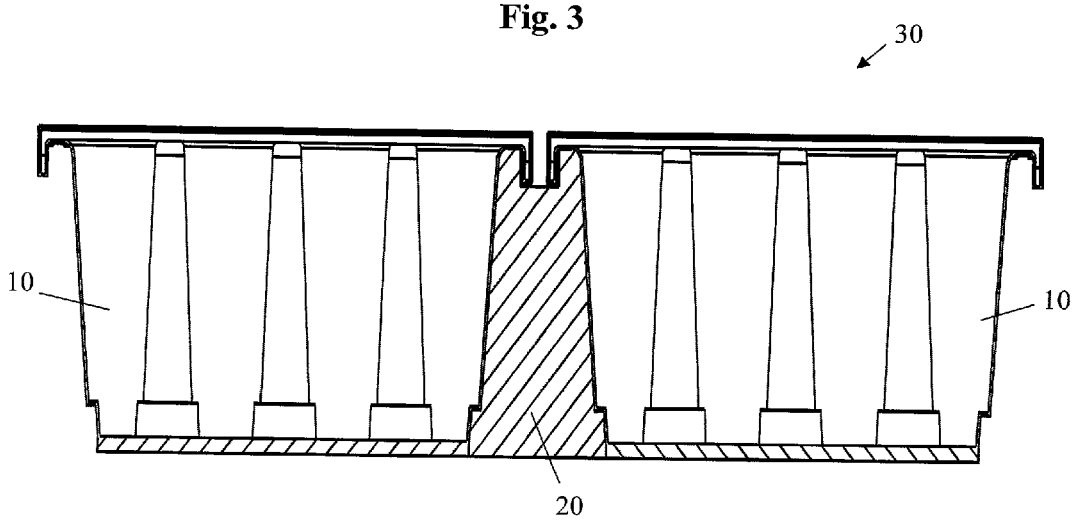
FIG. 3 is a sectional view through a part of a flood barrier 300 according to an embodiment of the present invention.

As shown in FIG. 1E and in FIG. 3, in the present embodiment lip 130 extends downwards over an upper portion of each connection slot 150 to form an upper locking portion 155. This co-operates with an upper portion of a connection piece of the type shown in FIGS. 2A-2C to lock the connection piece in place.

In addition to upper locking portion 155, in the present embodiment a recess 160 is provided at the lower extent of each connection slot 150 to form a lower locking portion. Recess 160 is substantially symmetrical about the vertical and extends a short distance upwards from base 115 such that, as shown in FIG. 3, each connection slot 150 has a vertical cross-section including a stepped portion at its lower extent. As shown in FIG. 1E, recess 160 is wider than the widest portion of connection slot 150, such that recess 160 has a substantially T-shaped horizontal cross-section. This provides a lip 165 that engages a corresponding portion of a connection piece of the type shown in FIGS. 2A-2C to secure the connection piece in connection slot 150. Recess 160 and lip 165 are arranged so that the weight of unit 100 acts upon a connection piece, compressing these together and thereby improving the seal between them.

The dimensions of the upper and lower locking portions are not critical, but should be chosen to complement the dimensions of the connection piece of the type shown in FIGS. 2A-2C. It will also be appreciated that providing more or fewer locking portions, in the same or different location(s) as those of the present embodiment, is also within the scope of the present invention.

Figure 1D:
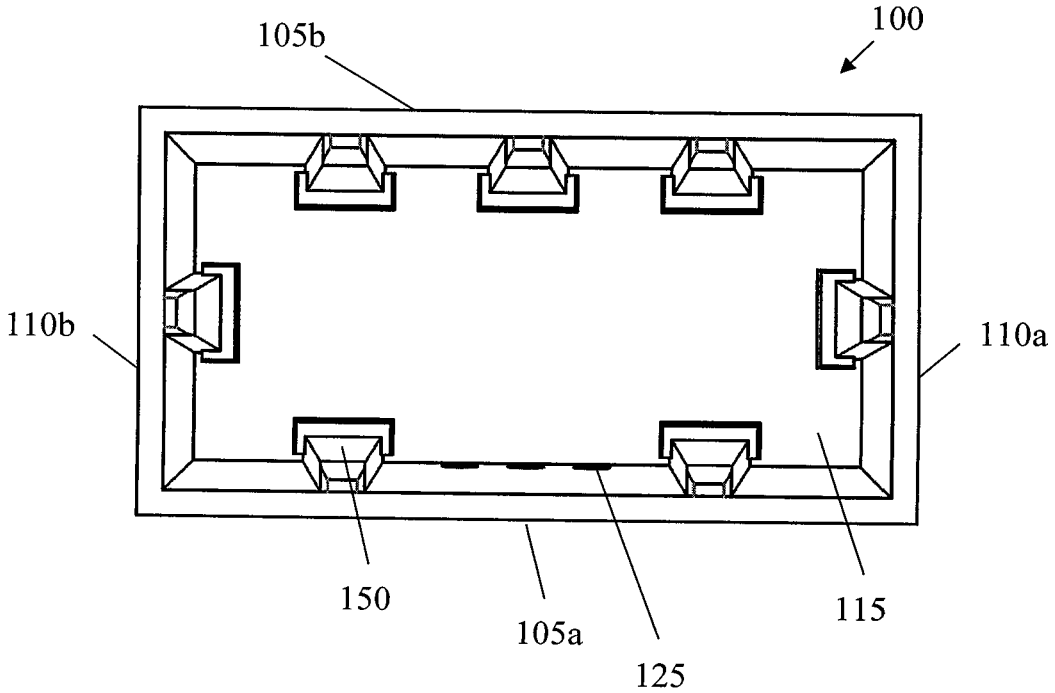
FIG. 1D is a top view of the modular unit of FIG. 1A.
Figure 1E:
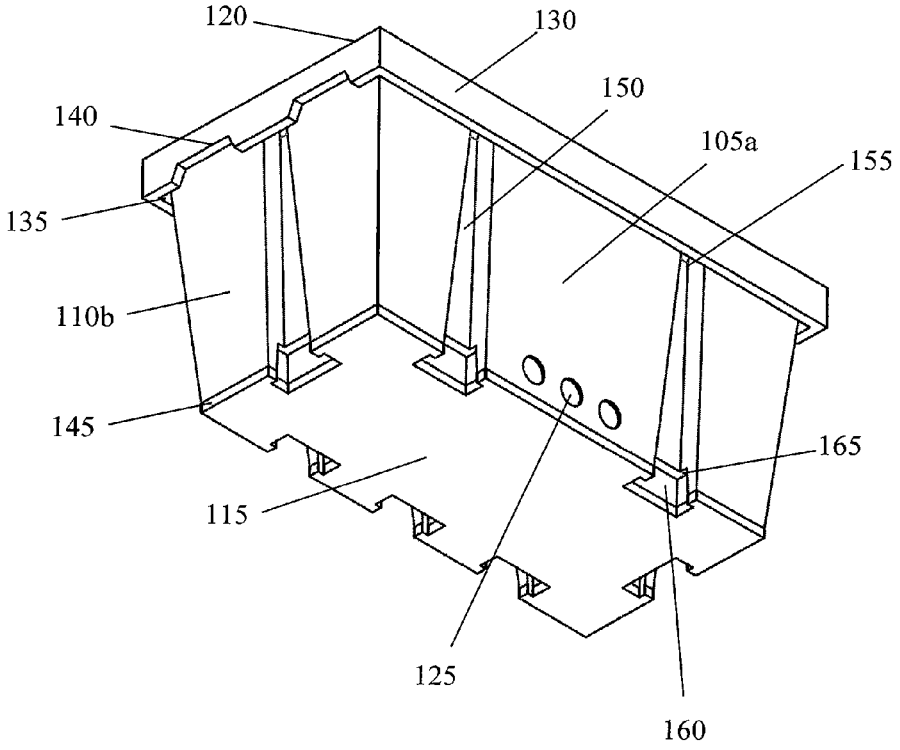
FIG. 1E is a bottom-up perspective view of the modular unit of FIG. 1A.

As shown most clearly in FIG. 1D, connection slots on opposing walls are preferably aligned with one another to form opposing pairs of connection slots. An exception to this pairing arrangement is when a connection slot is located directly opposite at least one self-filling hole; in this situation, it is preferred that no opposing connection slot is provided to avoid the having a connection slot that overlaps with one or more self-filling holes. An example of this arrangement is shown in FIG. 1D, as middle connection slot on back wall 105*b* does not have an opposing counterpart on front wall 105*a* due to the presence of self-filling holes 125.

The provision of connection slots on more than just the end walls of unit 100 increases the number of ways that units like unit 100 can be interconnected. For example, the embodiment shown in FIGS. 1A-1E allows end-to-end connection between adjacent units; i.e., adjacent units may be connected such that an end wall of one unit is opposed to and proximate an end wall of the adjacent unit. The embodiment shown in FIGS. 1A-1E also allows front-to-back, back-to-front, front-to-front, back-to-back, end-to-front, front-to-end, end-to-back and back-to-end connections between adjacent units. The paired arrangement of connection slots advantageously reduces the time and effort required to deploy unit 100, as adjacent units can be interconnected without having to first ensure that they are identically orientated. Moreover, this arrangement of connection slots allows barriers of any length that incorporate any number of corners to be easily and quickly constructed. Barriers that are multiple units deep can also easily be created by, for example, front-to-back, front-to-front, end-to-front, or end-to-back connections. Wider barriers may be particularly useful in situations where the additional ballast of a second unit is required, such as when rapidly flowing flood water is present.

In a particularly preferred embodiment front and back walls 105*a*, 105*b* are at least twice the length of end walls 110*a*, 110*b* and at least one of front wall 105*a* and back wall 105*b* is provided with three equispaced connection slots. This arrangement allows a single unit to simultaneously support two end-to-front or end-to-back connections, producing a T-shaped arrangement when viewed from above. This type of arrangement may be useful in situations where the significant additional ballast of a second and third unit is required, such as when a large volume of rapidly flowing flood water is present, or in situations where a two-sided barrier is required.

A tapered connection piece 200 according to an embodiment of the present invention that is suitable for connecting units like unit 100 together to form a barrier is shown in FIGS. 2A-2C. Connection piece 200 sealingly engages with unit 100 via any connection slot 150 that is provided in unit 100 and is dimensioned accordingly. Specifically, connection piece 200 is slightly shorter than unit 100 and, in the present embodiment, is approximately 0.49 m in height. The width of connection piece 200 is chosen such that it is sufficient to allow two units like unit 100 to be connected together using a single connection piece 200. The thickness of connection piece 200 is chosen relative to the thickness of connection slot 150 such that a tight friction fit is obtained when connection piece 200 is in place. An example of this type of connection is shown in FIG. 3. In the present embodiment, connection piece 200 is 0.28 m wide and 12 cm thick at its base, where it is thickest, although connection pieces having other dimensions are also within the scope of the present invention.

Connection piece 200 is preferably made from a material having negative buoyancy, i.e. a material that will sink when placed in a volume of the fluid that a barrier formed from units like unit 100 is to come into contact with. This ensures that a barrier formed by the interconnection of units like unit 100 has at least the minimum amount of ballast required to hold back fluid flow. In the present embodiment the fluid is assumed to be water, and so connection piece 200 is made of polyvinyl chloride (PVC) that has a density greater than 1000 $kg/m^3$, i.e. greater than the density of water. In some embodiments, connection piece 200 is made of recycled PVC. Where the barrier is to be deployed against other fluids, e.g. a mixture of water and other material, the required density of the connection piece 200 may be varied accordingly.

As shown in FIGS. 2A and 2C in particular, in the present embodiment connection piece 200 comprises a trapezoidal body portion 205 surrounded by a frame 210 that is approximately shaped like a truncated rectangular pyramid. This shape is not essential, and other shapes for frame 210 like a truncated square pyramid, for example, may be used providing they allow connection piece 200 to sealingly engage with one connection slot in each of a pair of adjacent units that are like unit 100 when said pair of units are deployed as part of a flood barrier. Preferably the shape of frame 210 is chosen so that it has a degree of taper similar to the taper of connection slot 150, more preferably with a degree of taper substantially identical to the second taper of connection slot 150. Matching the taper of connection piece 200 and connection slot 150 ensures that a good watertight seal is maintained along the entire length of connection piece 200.

An air gap is provided at the top of frame 210 such that the upper surface of body 205 and the exposed cross-section of frame 210 define an upper locking portion 215 comprising an opposing pair of flanges 220*a*, 220*b* that are substantially identical to one another. The air gap at the top of frame 210 is preferably at least twice the thickness of the overhanging portion of lip 130 of unit 100, as this provides sufficient space for two units like unit 100 to be connected together via a single connection piece 200 in the manner shown in FIG. 3.

Each of flanges 220*a*, 220*b* is dimensioned to fit within upper locking portion 155 of connection slot 150. A tight frictional fit is preferred so that connection piece 200 is held firmly in place and a good watertight seal is obtained between flange 220*a*, 220*b* and lip 130. A tight frictional fit also means that connection piece 200 will act as ballast for unit 100.

Sealing strips 225*a*, 225*b* are provided along the entire length of each side of connection piece 200 and along the top of each flange 220*a*, 220*b*. A sealing layer 230 is provided on the base of connection piece 200. In the present embodiment sealing strips 225*a*, 225*b* and sealing layer 230 are foam gasket strips, but other suitable materials known to the skilled person may be used instead. Sealing strips 225*a*, 225*b* assist in forming a sealing contact between a side of connection piece 200 and a wall 105*a*, 105*b*, 110*a*, 110*b* of unit 100 to prevent fluid passage. Sealing layer 230 forms a substantially watertight seal between the base of connection piece 200 and the surface below it, preventing fluid from passing underneath connection piece 200.

Two substantially identical opposing step-like protrusions 235*a*, 235*b* are provided on the bottom of frame 210. Each of protrusions 235*a*, 235*b* co-operate with recess 160 to lock connection piece 200 in place, as is shown in FIG. 3. The combination of flanges 220*a*, 220*b* and protrusions 235*a*, 235*b* serve to prevent connection piece 200 from moving in any direction other than downwards once connection piece 200 is secured in place.

Downwards motion of connection piece 200 during deployment is prevented by the surface that connection piece 200 and unit 100 are in contact with. Preferably the friction fit between connect piece 200 and unit 100 is sufficiently tight that any upward motion of unit 100, such as e.g. due to a wave in flood water, will not dislodge connection piece 200. Connection piece 200 can be disengaged by downward motion when base 115 is not in contact with the ground, e.g. by tipping unit 100 up onto one side.

In a preferred embodiment the thickness of each protrusion 235*a*, 235*b* and the width of frame 210 are both selected so that the total width of connection piece 200 at its widest point (i.e. at the base) is at most equal to the shortest distance between opposing pairs of connection slots (i.e. the distance between opposing pairs of connection slots as measured at the base of unit 100). This allows connection piece 200 to be laid flat on base 115 of unit 100 while in transit, so that an efficient stacking arrangement like that shown in FIG. 4A can be achieved. In some non-illustrated embodiments, a plurality of connection pieces like connection piece 200 may be stored inside a single unit. This may be achieved by laying the connection pieces one on top of the other to form a vertical stack of connection pieces within unit 100.

As shown most clearly in FIG. 2C, connection piece 200 may include an indentation 240 that extends vertically along at least a part of the vertical extent of body portion 205. Indentation 240 is positioned such that it vertically bisects body portion 205. In the present embodiment the indentation is approximately 2 mm deep, but other depths may be used, although the indentation should not be so deep that it compromises the structural integrity or sealing ability of connection piece 200. In the present embodiment indentation 240 is provided only one face of body 205, but it will be appreciated that an identical indentation could be provided on the opposite face of body 205.

The purpose of indentation 240 is to provide a visual guide to allow connection piece 200 to be precisely cut in half along its length. Connection piece 200 may be cut in half in this manner to produce a connection piece like connection piece 600 shown in FIG. 6A and described later in this specification. Connection piece 600 is suitable for sealingly engaging with a substantially vertical structure such as the wall of a building.

FIG. 3 shows a sectional view through a part of a flood barrier 300 according to an embodiment of the present invention. Flood barrier 300 is formed from a plurality of units like unit 100 that are connected in an end-to-end configuration using a plurality of connection pieces like connection piece 200. In the interests of clarity only two units are shown in FIG. 3, but it will be appreciated any number of units can be connected in this manner. FIG. 3 is provided primarily to illustrate the manner in which adjacent units like unit 100 are connected by connection piece 200 and is therefore supplementary to the discussion above provided in respect of FIGS. 1A-1E and FIGS. 2A-2C.

As can be seen in FIG. 3, connection piece 200 co-operates with connection slot 150 to achieve a good watertight seal between adjacent units in a barrier.

As shown in FIG. 2C, flanges 220*a*, 220*b* and upper locking portion 215 are located at the top of connection piece 200. This means that a barrier like that shown in FIG. 3 can be assembled by lowering unit 100 onto a connection piece that has already been deployed. This facilitates quick assembly of the barrier. In addition, when the barrier needs to be disassembled, unit 100 can be pulled upwardly away from connection piece 200. This allows a unit that is at an intermediate position along the length of a barrier (i.e. not at either end) to be removed in isolation of and without significantly disturbing the other units, making the replacement of any particular unit in a barrier quick and easy to perform. The user also does not need to contend with the weight of the connection piece itself when disassembling the barrier.

Figure 4A:
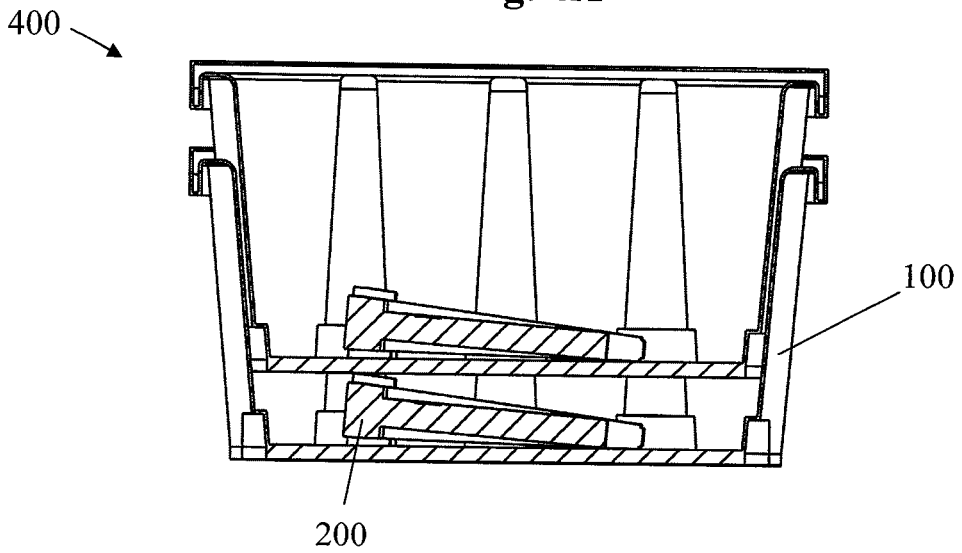
FIG. 4A is a sectional view through a pair of units according to the present invention that are in a stacked arrangement.

FIG. 4A is a sectional view through a pair of units like unit 100 that are arranged in a stack 400. Connection piece 200 is stored between adjacent units in stack 400 so that it does not take up additional space. The tapered walls of unit 100 facilitate vertical stacking in this manner. This arrangement is highly efficient in terms of space usage and allows a number of units and connection pieces to be stored on a single pallet 410 in the manner illustrated in FIG. 4B. In one non-illustrated embodiment, a single 800×1200 mm pallet (EUR pallet) is capable of holding thirty units and thirty connection pieces. This multi-stack arrangement therefore offers at least the advantage that it is easy to transport a large number of stackable units like unit 100.

Figure 5:
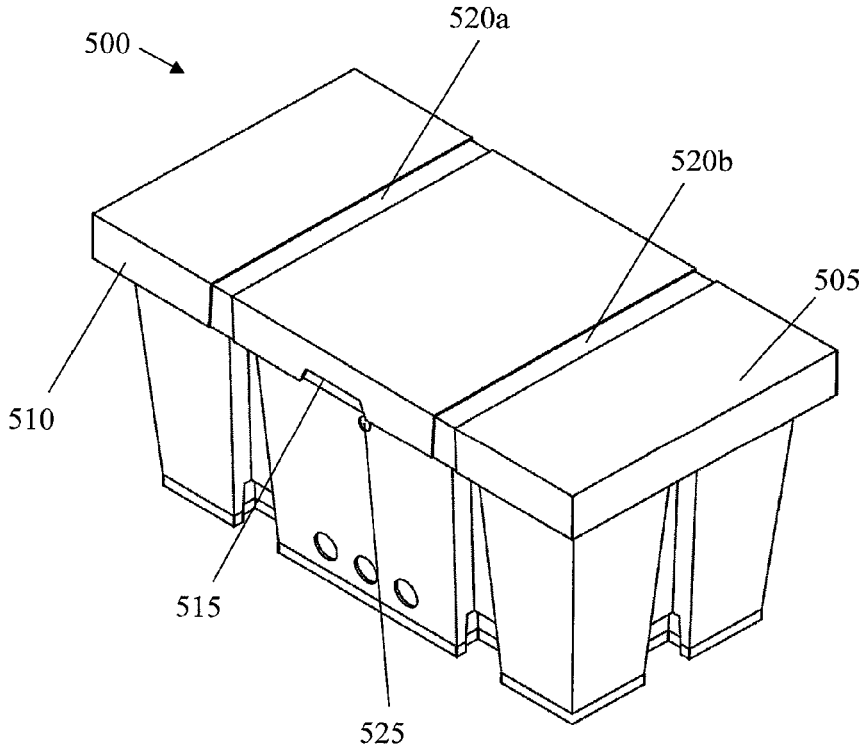
FIG. 5 is a perspective view of a covered unit according to another embodiment of the present invention.

FIG. 5 shows a unit 500 that is particularly suited for deployment as part of a flood defence system or flood barrier in situations where a particularly high level of flood water is present. Unit 500 is identical to unit 100 but additionally has a lid 505 that covers substantially all of its top surface.

Lid 505 is substantially flat and includes an overhang 510 that extends downwards towards unit 500. Overhang 510 is provided around the entire perimeter of unit 500 and acts to stop lid 505 from accidentally sliding off unit 500. A hand hold 515 is provided along one long edge of overhang 510. Another hand hold (not shown) is provided in the same place along the opposite long edge of overhang 510, so that an opposing pair of hand holds are provided. Hand hold 515 comprises a recessed portion in overhang 510 that is suitable for gaining purchase on lid 505, either by hand or with a suitable tool, in order to lift lid 505 off and away from unit 500.

In the present embodiment the hand holds are located in the middle of the long edges of lid 505, but this is not essential and other locations may be provided for hand holds. It is preferred that the location for hand holds is chosen such that they are readily accessible regardless of whether unit 500 is approached from the front, back or side. It will be appreciated that more or fewer hand holds may be provided in lid 505 at any location around its perimeter without departing from the scope of the present invention. In some alternative embodiments, hand holds are not provided as opposing pairs. In another alternative embodiment, no hand holds are provided in lid 505.

Figure 8:
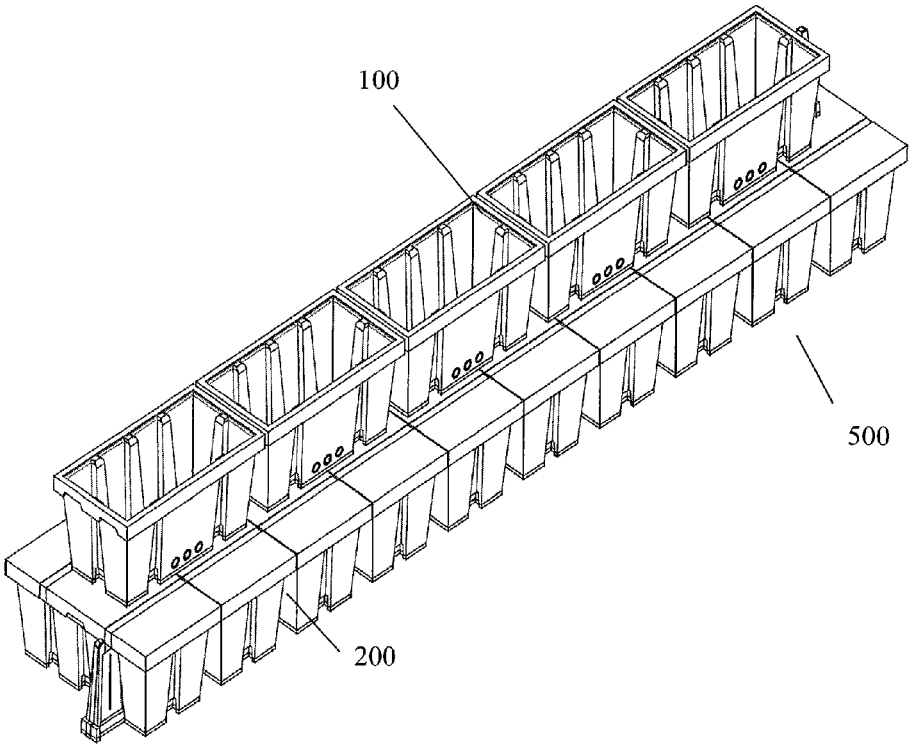
FIG. 8 is a perspective view of a stacked barrier according to an embodiment of the present invention.

In the present embodiment lid 505 is made of medium density polyethylene, but any other material capable of supporting the weight of a unit like unit 100 or unit 500 can be used instead. This is because lid 505 is provided to allow another unit like unit 100 or unit 500 to be placed on top of unit 500, in order to provide a flood barrier that is twice the height of unit 500. A barrier of this type is shown in FIG. 8.

As shown in FIG. 5, lid 505 includes two straight grooves 520*a*, 520*b* that span substantially all of its upper surface and continue onto overhang 510. Grooves 520*a*, 520*b* may be aligned with connection slots identical to connection slot 150 described earlier that are provided in the body of unit 500. Grooves 520*a*, 520*b* serve as a convenient visual aid for determining whether an upper unit is centered relative to lower units when arranged as a vertically stacked barrier of the type shown in FIG. 8. This allows a stacked barrier of this type to be reliably assembled. Other embodiments having any number of grooves, including zero, are also within the scope of the present invention.

In some circumstances it is advantageous to deploy unit 500 as a pre-filled unit. In these circumstances any self-filling holes that are present in unit 500 are sealed before deployment using a suitable sealing means such as a screw-in cap.

Figure 4B:
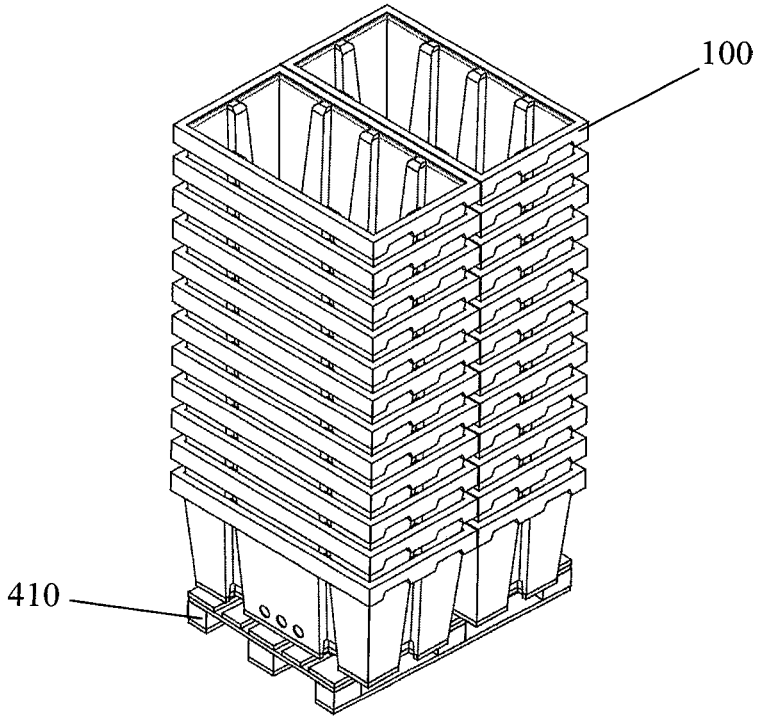
FIG. 4B is a perspective view of units according to the present invention that are in a stacked arrangement.

Lid 505 may be easily removed when unit 500 is not in use, such that unit 500 can also be stored in a stacked arrangement like that shown in FIGS. 4A and 4B.

As shown in FIG. 5 unit 500 may include an optional air release hole 525 that allows air to escape from the interior of unit 500 when it is deployed as a self-filling unit, in order to assist the filling of unit 500.

In the present embodiment air release hole 525 is circular and has a diameter of approximately 5 mm. The circular shape of air release hole 525 is however not critical, and other shapes such as square or rectangular may be used instead of circular. The size of air release hole 252 is also not critical, and holes of any other size may be used. Preferably a small hole is provided so that the structural integrity of unit 500 is not compromised.

In the present embodiment a single air release hole 525 is provided in the front wall of unit 500, but it will be appreciated that at least one air release hole may be provided in any other of the walls of unit 500, or indeed in lid 505, or in some combination thereof. Preferably, if air release holes are provided in any of the walls of unit 500, they are located near the top of the walls, or at least above the expected maximum height of the fluid against which unit 500 is to be deployed, so that the air release holes do not act as self-filling holes by allowing fluid to enter the interior of unit 500.

In the present embodiment only a single air release hole is present, but any number of air release holes may be provided. Air release hole 525 may be plugged using a suitable removable means such as a screw-in cap or bung, either before or after deployment of unit 500. Preferably any air release holes are sealed before deploying unit 500 as a pre-filled unit. Any air release holes may also be sealed if lid 505 is removed from unit 500, such that it becomes an open top unit like unit 100.

Figure 6A:
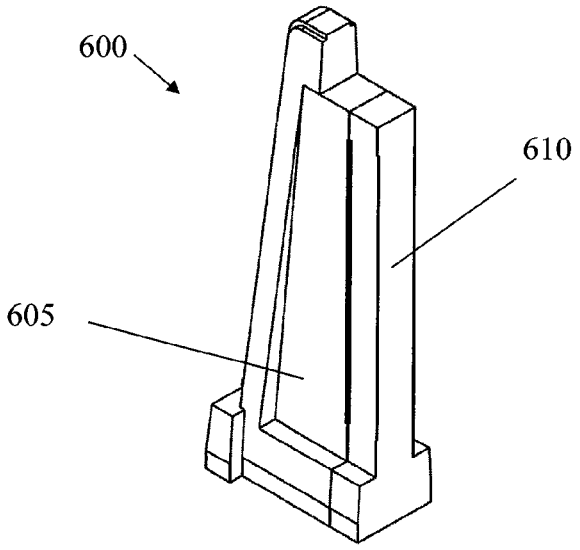
FIG. 6A is a perspective view of a connection piece that is suitable for sealing against vertical surfaces according to an embodiment of the present invention.

FIG. 6A shows a connection piece 600 according to another embodiment of the present invention. Connection piece 600 comprises a body 605 having the appearance and construction of a connection piece 200 that has been vertically bisected, by for example cutting along a straight path that is collinear with indentation 240, and a sealing layer 610 appended to the flat face of body 605 that was exposed by the bisection. In the present embodiment sealing layer 610 is a foam gasket, but other suitable materials known to the skilled person may be used instead of or in addition to a foam gasket. Preferably sealing layer 610 extends along the entire length of the flat face of body 605.

Typically two connection pieces like connection piece 600 will be formed by cutting a connection piece like connection piece 200 in half at a manufacturing plant. However, by providing indentation 240 in connection piece 200, the flexibility of the modular system provided by the present invention is improved, since it allows the end user to accurately cut a single connection piece like connection piece 200 in half to produce two entities that, with the addition of sealing layer 610, become connection pieces like connection piece 600. In this case it may be advantageous to separately provide at least one sealing layer 610 to the end user, to allow the end user to attach this sealing layer after bisecting a connection piece like connection piece 200.

Figure 6B:
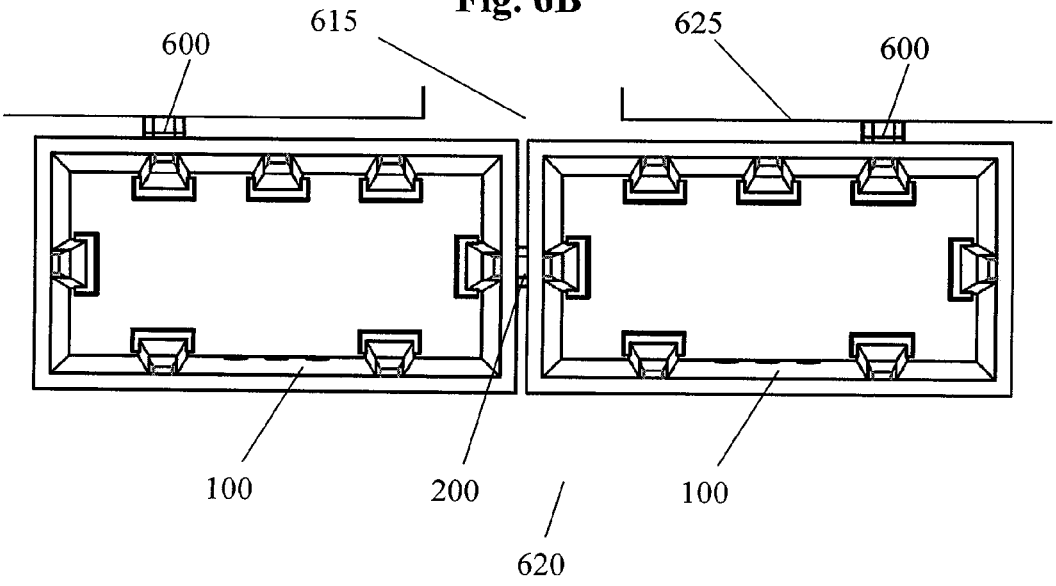
FIG. 6B is a top view of a barrier according to an embodiment of the present invention that makes use of the connection piece of FIG. 6A.

Connection piece 600 is particularly suited for creating a water tight seal between units like unit 100 and/or 500 and a substantially vertical surface, such as the wall of a building. One embodiment illustrating connection piece 600 in use in this manner is shown in FIG. 6B. Two units like unit 100 are deployed around a doorway 615 and connected in an end-to-end arrangement using a connection piece like connection piece 200. Units 100 are oriented such that their front walls face flood plain 620, to allow fluid to enter units 100 via the self-filling holes located in their front walls.

A connection piece like connection piece 600 is placed in sealing contact with one of the connection slots on the back wall of each of the units. The units are positioned such that the sealing layer 610 of each of the connection pieces 600 is in sealing contact with building wall 625. The result is a flood barrier that prevents fluid from flood plain 620 accessing doorway 615 from any direction. Doorway 615 is thus fully protected from flood damage using a small number of individual units, and in this embodiment only two units are required. Equivalent protection with prior art protection means, such as sandbags, typically requires far more units than this, meaning prior art flood barriers typically take longer to erect and are more expensive than embodiments of the present invention.

It will be appreciated that the embodiment shown in FIG. 6B may be modified by interchanging one or more units 100 with one or more units 500, and that the resulting barrier is within the scope of the present invention. In addition, other modification, such as connecting further units in a front-to-back, front-to-front, front-to-end and/or end-to-end configuration are also within the scope of the present invention.

In an alternative non-illustrated embodiment, a single unit 100 or 500 is used to protect a doorway that is narrower than the length of a single unit 100 or unit 500. In this embodiment unit 100 or 500 is deployed so that its back wall is parallel with and opposite the doorway and such that at least one connection slot is located on each side of the doorway. A connection piece like connection piece 600 is provided in at least these connection slots, so that a fluid barrier is formed on each side of the doorway. Fluid is thus prevented from coming into contact with the doorway by using only a single unit.

In some circumstances it may be particularly advantageous to deploy additional units in a front-to-back configuration, so that a wider barrier is formed between doorway 615 and flood plain 620. In some circumstances it may be particularly advantageous to deploy additional units in an end-to-end configuration, where these additional units also include connectors like connector 600. This creates further seals against wall 625, providing 'back up' seals in the unlikely event that any fluid manages to penetrate the wall seals of the outermost units. These and other such modifications are also within the scope of the present invention.

Two different flood barriers according to embodiments of the present invention are now described in connection with FIGS. 7 and 8.

Figure 7:
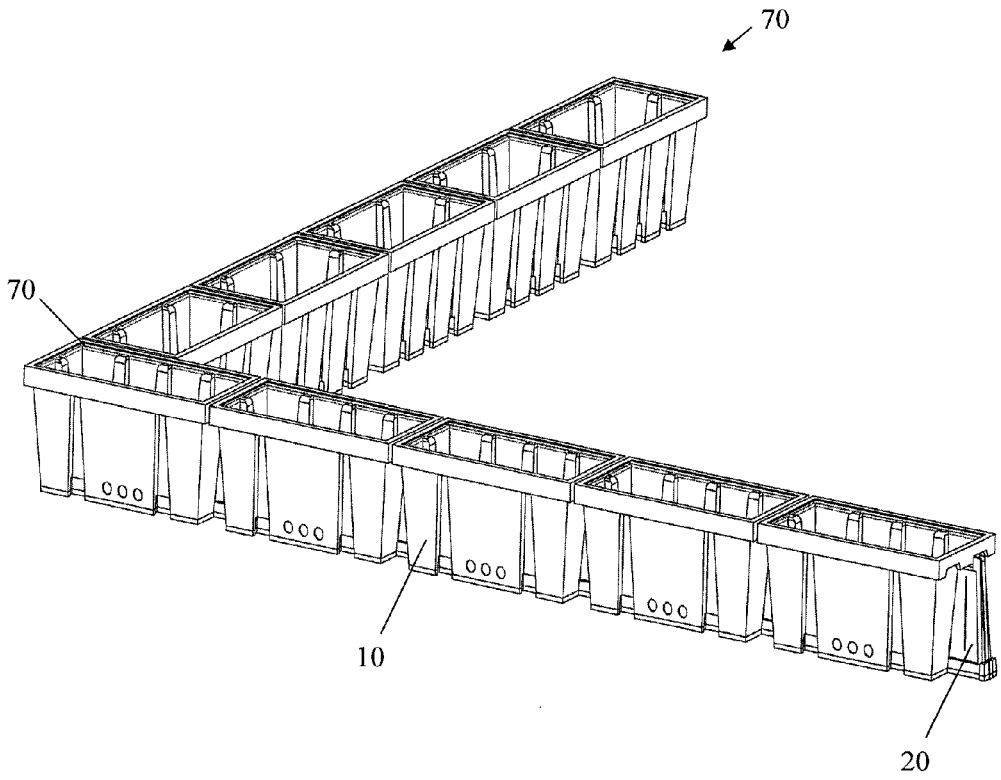
FIG. 7 is a perspective view of a barrier that includes a corner, according to an embodiment of the present invention.

FIG. 7 is a perspective view of part of a flood barrier 700 according to an embodiment of the present invention. Flood barrier 700 is formed from a number of units like unit 100 that are connected using a number of connection pieces like connection piece 200. Flood barrier 700 also includes a corner 705 that comprises a back-to-end type connection between adjacent units. This type of flood barrier may additionally or alternatively include one or more units like unit 500, or it may be formed entirely of units like unit 500. At least some of units 100 and/or units 500 may be pre-filled, and at least some of units 100 and/or units 500 may be self-filling. It will be appreciated that additional corners like corner 705 may be included in a flood barrier like barrier 700 without departing from the scope of the present invention. It will also be appreciated that a barrier like barrier 700 may include one or more wall sealing connection pieces like connection piece 600 without departing from the scope of the present invention.

FIG. 8 is a perspective view of part of another flood barrier 800 according to an embodiment of the present invention. Flood barrier 800 is a stacked barrier and comprises a lower layer 805 formed from a number of interconnected units having a lid like unit 500 and an upper layer formed from a number of interconnected units like unit 100. All the units are connected to adjacent units via connection pieces like connection piece 200. It will be appreciated that a barrier like barrier 800 may include one or more wall sealing connection pieces like connection piece 600 without departing from the scope of the present invention.

In the present embodiment the units forming lower layer 805 are deployed in a front-to-back configuration and the units forming upper layer 810 are deployed in an end-to-end configuration. This configuration is however not essential, and other configurations may be used instead.

Stacked barrier 800 is twice the height of a barrier formed from only a single layer of units and is thus particularly suited for protecting against a high volume of flood water. Moreover, it will be appreciated that a barrier of any desired height may be obtained by repeatedly stacking units like units 100 and 500 in a vertical arrangement.

Various modifications to barrier 800 are possible. For example, at least some of units 500 and/or units 100 may be pre-filled. In some circumstances it may be advantageous to form upper layer 810 from at least some units like unit 500. These and other such modifications are also within the scope of the present invention.

In addition to the embodiments of the invention described in detail above, the skilled person will recognize that various features described herein can be modified and combined with additional features, and the resulting additional embodiments are also within the scope of the present invention.

The invention claimed is:

1. A unit suitable for deployment as part of a flood barrier, comprising:

a hollow body comprising a base and at least one wall, wherein an angle between the at least one wall and the base is greater than 90 degrees;

wherein the at least one wall includes at least one recess therein, each recess forming a connection slot that is suitable for accepting a connection piece, each said connection piece comprising a trapezoidal body, and a frame shaped like a truncated rectangular pyramid surrounding said trapezoidal body, said frame having a base that is wider than a top of said frame and forming a ledge with the respective base and sides of said trapezoidal body.

2. The unit according to claim 1, wherein each connection slot is tapered in a plane perpendicular to the plane of the at least one wall.

3. The unit according to claim 1, arranged such that at least a component of the weight of the unit acts to improve the seal between the unit and said connection piece.

4. The unit according to claim 3, wherein the unit is self-filling and wherein the seal between the unit and said connection piece is improved as the unit fills.

5. The unit according to claim 1, wherein the unit comprises opposing front and back walls and first and second opposing end walls, at least three of said walls including at least one connection slot.

6. The unit according to claim 5, wherein each of the end walls includes only one connection slot, the front wall includes only two connection slots and the back wall includes only three connection slots.

7. The unit according to claim 6, wherein the front and back walls are at least twice the length of each end wall and wherein the connection slots on the back wall are equispaced along said wall.

8. The unit according to claim 5, wherein the front wall includes at least one hole for allowing flood water to enter said hollow body and thereby act as additional ballast for said unit.

9. The unit according to claim 8, wherein all of the holes are sealable to enable the unit to be filled with a ballast material before deployment.

10. The unit according to claim 1, further comprising a sealing layer on said base.

11. The unit according to claim 10, wherein the sealing layer comprises a foam gasket layer.

12. The unit according to claim 1, wherein each connection slot is substantially identical to every other connection slot, and wherein each connection slot includes at least one locking portion suitable for securing said connection piece in place.

13. The unit according to claim 12, wherein each connection slot further comprises:

an upper locking portion; and a lower locking portion.

14. The unit according to claim 13, wherein the lower locking portion comprises a recess having a substantially T-shaped horizontal cross-section.

15. The unit according to claim 14, wherein said frame has opposing step-like protrusions received in corresponding recesses of said units.

16. The unit according to claim 1, wherein the walls of the unit are angled to enable the unit to accommodate at least a portion of a second identical unit within its hollow body, such that the combination of a plurality of such units is able to stack vertically.

17. The unit according to claim 1, further comprising a removable lid.

18. The unit according to claim 1, wherein each said connection piece further comprises an indentation that provides a visual guide for where to cut said connection piece in half to use with said unit when said unit is placed adjacent a vertical wall.

19. A flood barrier, comprising:

a plurality of units suitable for deployment as part of a flood barrier, each unit comprising a hollow body comprising a base and at least one wall, wherein an angle between the at least one wall and the base is greater than 90 degrees, and wherein the at least one wall includes at least one recess therein, each recess forming a connection slot; and a plurality of connection pieces wherein each said connection piece comprises a trapezoidal body, and a frame shaped like a truncated rectangular pyramid surrounding said trapezoidal body, said frame having a base that is wider than a top of said frame and forming a ledge with the respective base and sides of said trapezoidal body, and wherein the plurality of units are connected together using said plurality of connection pieces such that said frame fits in corresponding said connection slots of said units so that a watertight barrier is formed.

20. The flood barrier according to claim 19, wherein each of said plurality of connection pieces is adapted to simultaneously sealingly engage one connection slot in each of a pair of adjacent units in said barrier.

21. The flood barrier according to claim 19, wherein at least one sealing strip is provided on each of said plurality of connection pieces to form a watertight seal between said connection piece and said unit.

22. The flood barrier according to claim 19, wherein each of said plurality of connection pieces further includes an opposing pair of flanges suitable for engaging with a locking portion of said connection slot.

23. The flood barrier according to claim 19, wherein each of said plurality of connection pieces has a density greater than the density of water.

24. The flood barrier according to claim 19, wherein the width of each connection slot is less than the width of the wall in which the connection slot is formed.

25. The flood barrier according to claim 19, wherein each of said plurality of connection pieces further includes an opposing pair of protrusions extending from said base of said frame suitable for engaging with a locking portion of said connection slot.

26. The flood barrier according to claim 19, wherein at least one unit in the barrier includes a truncated connection piece that is arranged to sealingly abut against a vertical surface.

27. The flood barrier according to claim 26, wherein the truncated connection piece comprises a vertically bisected connection piece having a sealing layer disposed along the face exposed by the bisection.

28. The flood barrier according to claim 19, wherein walls of each unit are angled to enable each unit to accommodate at least a portion of a second identical unit within its hollow body, such that the combination of a plurality of said units is able to stack vertically.

29. The flood barrier according to claim 28, wherein each unit is arranged to accommodate at least one of said plurality of connection pieces inside its hollow body when stacked vertically.

30. A vertically stacked flood barrier, comprising:

a first flood barrier and a second flood barrier, each flood barrier comprising a plurality of units suitable for deployment as part of a flood barrier, each unit comprising a hollow body comprising a base and at least one wall, wherein an angle between the at least one wall and the base is greater than 90 degrees, and wherein the at least one wall includes at least one recess therein, each recess forming a connection slot; and each flood barrier further comprising a plurality of connection pieces, wherein each said connection piece comprises a trapezoidal body, and a frame shaped like a truncated rectangular pyramid surrounding said trapezoidal body, said frame having a base that is wider than a top of said frame and forming a ledge with the respective base and sides of said trapezoidal body, and wherein the plurality of units are connected together using said plurality of connection pieces such that said frame fits in corresponding said connection slots of said units so that a watertight barrier is formed;

wherein each of the plurality of units forming the first flood barrier includes a removable lid positioned such that said second flood barrier can be deployed on top of said first flood barrier.

31. A horizontally extended flood barrier, comprising at least two flood barriers arranged adjacent and substantially parallel to one another and sealingly connected therebetween using a first plurality of connection pieces that are each arranged perpendicularly to the longitudinal axis of each barrier, wherein each flood barrier comprises a plurality of units suitable for deployment as part of a flood barrier, each unit comprising a hollow body comprising a base and at least one wall, wherein an angle between the at least one wall and the base is greater than 90 degrees, and wherein the at least one wall includes at least one recess therein, each recess forming a connection slot; and each flood barrier further comprising a second plurality of connection pieces, and wherein the plurality of units are connected together using said second plurality of connection pieces such that the combination forms a watertight barrier, each said connection piece of said first and second plurality of connection pieces comprising a trapezoidal body, and a frame shaped like a truncated rectangular pyramid surrounding said trapezoidal body, said frame having a base that is wider than a top of said frame and forming a ledge with the respective base and sides of said trapezoidal body.

* * * * *